US005163819A

United States Patent [19]

Pettitt

[11] Patent Number: 5,163,819

[45] Date of Patent: Nov. 17, 1992

[54] ASYMMETRICAL SUCTION PORTING FOR SWASH PLATE COMPRESSOR

[75] Inventor: Edward D. Pettitt, Burt, N.Y.

[73] Assignee: General Motors Corporation, Detroit, Mich.

[21] Appl. No.: 832,514

[22] Filed: Feb. 7, 1992

[51] Int. Cl.[5] ..... F04B 1/12; F04B 21/04

[52] U.S. Cl. ..... 417/269; 417/525; 417/550

[58] Field of Search ..... 417/550, 525, 529, 269, 417/553

[56] References Cited

U.S. PATENT DOCUMENTS 2,457,339 12/1948 Bertea ..... 417/550

4,360,321 11/1982 Copp ..... 417/269

*Primary Examiner*—Leonard E. Smith

*Assistant Examiner*—Roland McAndrews

*Attorney, Agent, or Firm*—Ronald L. Phillips

[57] ABSTRACT

A swash plate compressor is disclosed having double acting pistons that reciprocate in aligned sets of horizontally extending bores of a cylinder block to compress gaseous refrigerant. An improved asymmetrical arrangement of suction or intake ports is provided in at least the bottommost piston. The ports extend longitudinally through the operating heads of the piston and are connected by an open channel so as to provide fluid communication through the piston. A matching valve disc with a flexible ring is included so as to provide unidirectional flow through the suction ports during the intake stroke. The suction ports are on a constant radius arc spaced 30° apart and are excluded from the lower 120° portion of the piston to form the asymmetrical arrangement. Liquid lubricant in the reservoir pool adjacent the bottom of the crankcase is sufficiently spaced from the ports so that it is prevented from being drawn through the suction ports and into the cylinder bore, thus eliminating slugging.

3 Claims, 2 Drawing Sheets

ASYMMETRICAL SUCTION PORTING FOR SWASH PLATE COMPRESSOR

TECHNICAL FIELD

The present invention relates to multiple cylinder axial compressors, and more particularly, to an improved intake or suction port arrangement providing increased reliability over the service life of the compressor.

BACKGROUND OF THE INVENTION

A variety of refrigerant compressors for use in vehicle air conditioning systems are currently available. A popular axial type compressor design includes multiple cylinders with double acting pistons. In this type of compressor, the cylinders are equally angularly spaced about and equally radially spaced from the axis of a central drive shaft. One set of such cylinders is provided at each of two opposing ends of the compressor. The double piston is mounted for reciprocal sliding motion in each set of opposed cylinders. Each piston is reciprocated by a drive plate, more commonly called a swash plate. During operation of the compressor, rotation of the drive shaft imparts a continuous wave-type reciprocating motion to the swash plate This driving of the swash plate in a nutating path around the drive shaft serves to impart a linear reciprocating motion to the pistons.

A thorough description of the operation of this type of compressor is disclosed in U.S. Pat. No. 4,360,321 to Copp, Jr. et al. (assigned to the assignee of the present invention) issued Nov. 23, 1982. In this compressor, the intake of refrigerant fluid into the cylinder and discharge therefrom is controlled by unidirectional reed-type valves located in valve plates at the ends of each cylinder. Annular intake and discharge chambers are provided in the compressor heads at each end of the compressor. A single port accommodates the transfer of fluid from the intake chamber to each cylinder bore, and a second port accommodates the transfer of fluid from each cylinder bore to the discharge chamber.

Improvements were previously made in this type of compressor by incorporating intake or suction ports into the ends of the pistons themselves. The ports are arranged in an annular array with equiangular spacing and at a constant radius from the longitudinal axis of the piston. Locating the intake suction ports in the ends of the pistons obviates the need for a separate intake chamber.

More particularly, during operation of the improved compressor, refrigerant fluid is communicated into the compressor and directed to the internal cavity or crankcase surrounding the swash plate, that is, on the back side of the pistons. As a piston begins its intake stroke, this refrigerant is suctioned through the ports in the piston into the cylinder bore defined between the piston and the discharge valve plate. As the piston then begins its discharge stroke, reed valves block the return flow of the refrigerant through the ports in the piston, thereby forcing it to discharge through the discharge port.

While this compressor design realizes several advantages over its predecessor, additional improvements are still possible For example, under certain operating conditions the improved compressor design may suffer from "slugging." Slugging occurs when lubricating liquid enters the cylinder bore or compression chamber (i.e. the region defined between the piston and the valve plate). As the piston begins its discharge stroke, it is forced to compress this liquid as well as the refrigerant gas in the chamber. Since the liquid is substantially incompressible, the discharge stroke of the piston is inhibited.

Additionally, in a compressor subject to slugging, the compressor components are subjected to higher loads and stress. The trapped liquid slugs cause simulated shock or impact loading, especially as the piston nears the end of its stroke. This action causes not only repeated excess force and torque loading on the components, but greatly increases the noise during operation. Accordingly, a need clearly exists for a design improvement to reduce the adverse effects of slugging.

The slugging problem primarily results from the relocation of the suction port assembly in the piston in the new design, referred to above. That is, the equiangular port placement around the head of the piston necessarily results in the deleterious condition in which liquid pooled in the lubricant reservoir at the bottom of the compressor crankcase is susceptible to being drawn directly into the cylinder bore. To explain further, tiny liquid lubricant droplets are interspersed throughout the refrigerant gas as a mist. This mixture is introduced into the crankcase to provide lubrication for the swash plate, bearings, and other internal components. Gravity causes the liquid particles to collect and accumulate at the bottom of the crankcase. Under certain operating conditions, the liquid lubricant level rises above the lowermost suction ports in the piston, or the lubricant splashes up during hard cornering, braking or the like. Consequently, as this piston reciprocates, this liquid is directly drawn from the crankcase reservoir into the cylinder bore.

SUMMARY OF THE INVENTION

It is accordingly a primary object of the present invention to provide an intake porting arrangement or assembly in a piston of a refrigerant compressor for use in a vehicle air conditioning system that reduces slugging.

Another object is to provide an intake porting assembly in the piston of an automotive refrigerant compressor that provides improved performance.

Still another object of the present invention is to provide an intake porting assembly in the piston of an automotive refrigerant compressor that yields both improved efficiency of operation, increased reliability, reduced stress on component parts and lower noise level over that of prior art compressor porting systems.

Additional objects, advantages and other novel features of the invention will be set forth in part in the description that follows and in part will become apparent to those skilled in the art upon examination of the following or may be learned with the practice of the invention. The objects and advantages of the invention may be realized and obtained by means of the instrumentalities and combinations particularly pointed out in the appended claims.

To achieve the foregoing and other objects, and in accordance with the purposes of the present invention as described herein, an improved compressor is provided that includes an intake or suction port arrangement that substantially reduces the effects of slugging. In its broadest aspects, the improvement of the present invention relates to the arrangement of the suction ports in the piston. More specifically, the suction ports are arranged such that the lowermost ports of the porting assembly, particularly in the bottommost pistons of the array, are eliminated, but without sacrifice in performance of the compressor.

In particular, a plurality of intake/suction ports extend longitudinally through the operating head or end of each piston. Unidirectional flow through the ports is assured by a valve disc comprising a flexible ring supported from the center by a cross piece. The ring flexes away from the piston to permit fluid to flow during the expansion or intake stroke from the crankcase through the piston suction ports and into the cylinder bore or compression chamber. In contrast, the ring blocks retro fluid flow through the ports from the cylinder bore to the crankcase during the compression stroke.

More specifically, as the piston reciprocates within the cylinder, a constantly changing pressure differential is realized between the crankcase and the compression chamber. During the intake stroke, the volume of the compression chamber increases, thereby creating a low pressure region Since the crankcase region maintains a relatively constant pressure, a positive pressure differential is realized between the two resulting in a suction force through the ports causing fluid to flow from the crankcase into the compression chamber.

On the discharge stroke, the volume of the compression chamber is decreased, thereby resulting in a high pressure region. The resulting negative pressure differential created between the crankcase and the compression chamber causes the fluid in the compression chamber to attempt to return through the suction ports to the crankcase. However, the reed valves cover the suction ports preventing such a reverse flow of fluid. Accordingly, the fluid within the compression chamber is forced into a discharge chamber through a discharge valve provided at the end of the cylinder. The refrigerant fluid then exits the compressor and is used to condition air.

The suction port assembly of the present invention is characterized by the ports being asymmetrically arranged about a central horizontal axis and connected by a channel. While consecutive ports are positioned with a constant radial and circumferential spacing, a discontinuity in the spacing is observed at the lower portion of the piston. Several advantages and benefits result from the elimination of ports in the lower part of the piston; that is, about an arc of substantially 120°. Among these benefits is the reduced effects of slugging, thereby yielding enhanced compressor performance.

As previously described, slugging occurs when liquid escapes the crankcase and enters the compression chamber. The effects are greatly intensified once the liquid level of the crankcase reservoir rises to a level equal to or above that of one or more of the suction ports. By eliminating the lowermost ports, the liquid lubricant in the crankcase cannot be drawn directly through a port into the compression chamber.

In the operation of the compressor, the liquid level in the reservoir remains at a substantially constant level. The present invention takes advantage of this and positions the lowermost ports above the equilibrium liquid level reached under any operating condition, thereby significantly reducing, and all but eliminating, the slugging problem.

By reducing the effects of slugging, a number of benefits are realized. For example, the compressor provides a greater throughput and therefore operates at a higher efficiency. Hence, improved cooling capacity of the air conditioning system is realized.

An additional benefit is observed in compressor reliability. As liquid is effectively prevented from being drawn directly into the compression chamber, the piston reciprocates much more freely, thereby reducing stress on internal bearings and other parts. Further, by retaining more liquid within the crankcase, a greater supply of lubricant is provided for the internal parts. The combination of better lubrication and smoother operation directly translates into a longer lasting compressor. Further, shock loading is eliminated, and the noise of operation is greatly reduced.

Still other objects of the present invention will become apparent to those skilled in this art from the following description wherein there is shown and described a preferred embodiment of this invention, simply by way of illustration of one of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWING

The accompanying drawing incorporated in and forming a part of the specification, illustrates several aspects of the present invention and together with the description serves to explain the principles of the invention. In the drawing.

Reference will now be made in detail to the present preferred embodiment of the invention, an example of which is illustrated in the accompanying drawings.

DETAILED DESCRIPTION OF THE DRAWINGS

Figure 1:
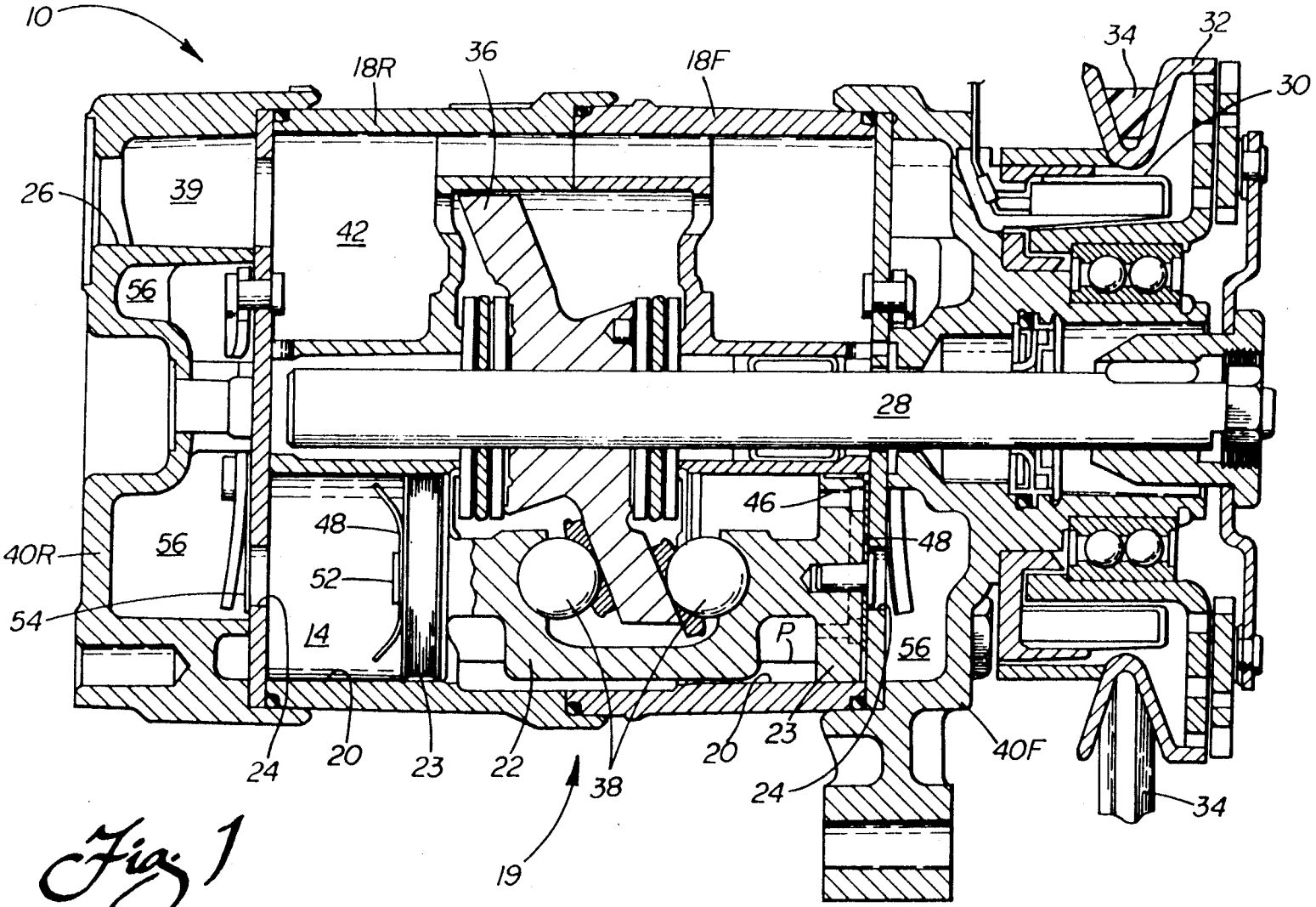
FIG. 1 is a cross-sectional view of the entire compressor including a showing of the bottommost piston, the uppermost suction port within that piston being in full line, and the lowermost suction port being in phantom line.
Figure 2:
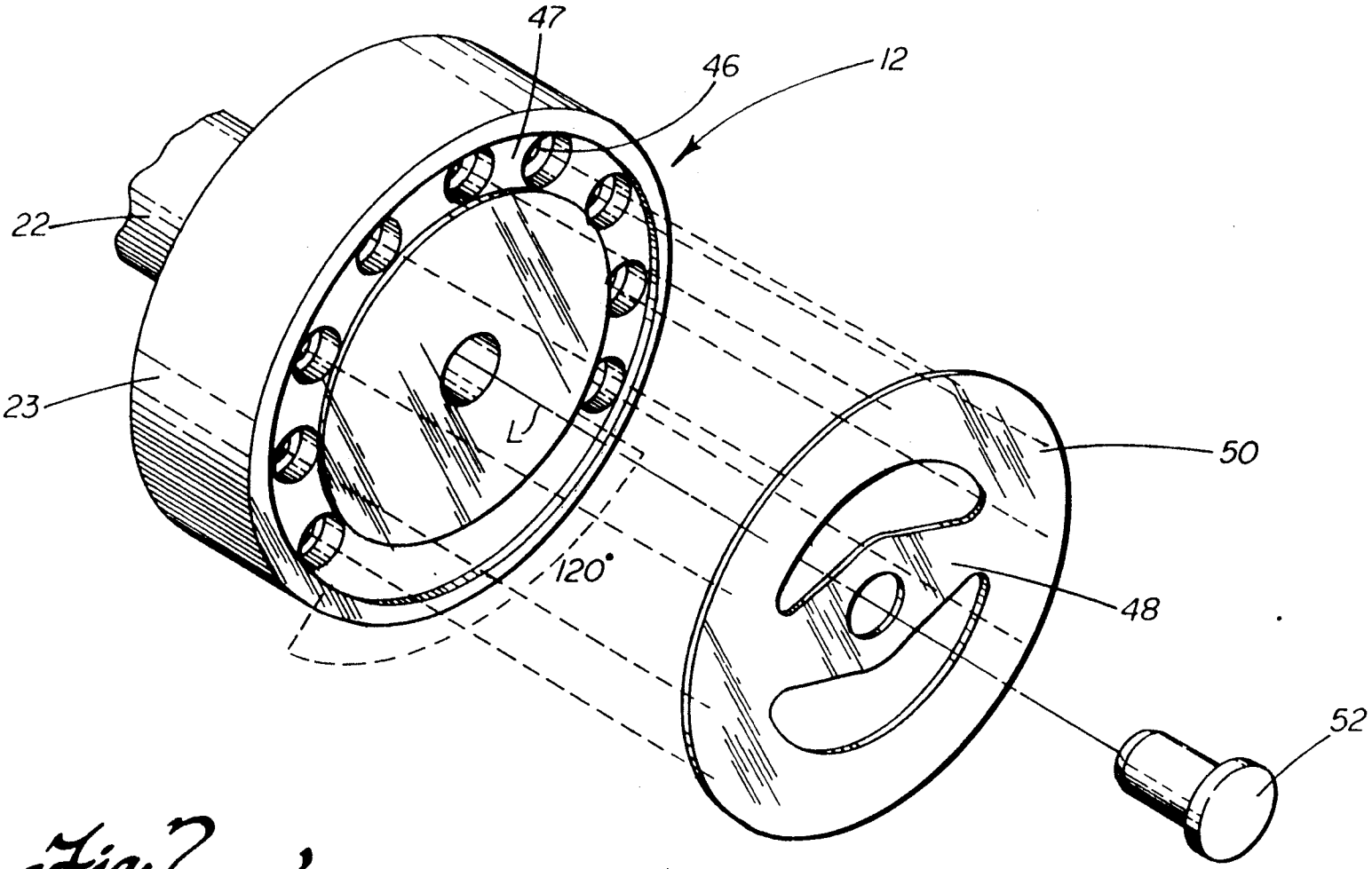
FIG. 2 is an exploded perspective view of the piston showing the novel configuration of the suction port array and the corresponding reed valve.

Reference is now made to FIG. 1 illustrating a cross section of a swash plate type compressor, generally designated by reference numeral 10. The compressor 10 includes an improved intake or suction porting assembly 12, at least, in the bottom most piston (see FIG. 2) and constructed in accordance with the teachings of the present invention. As should be appreciated from a review of the following description, the suction porting assembly 12 of the present invention improves compressor efficiency, reliability and quietness. These advantages result from elimination of ingestion of liquid lubricant into the compression chamber 14 of the cylinder bore 20 on the intake stroke of the piston 22. It should also be appreciated that the present invention is in no way limited to utilization in swash plate compressors incorporating double-ended pistons of the type described. Rather, the concepts of the present invention can also be adapted to other compressor configurations as well.

As is known in the art and shown, for example, in U.S. Pat. No. 4,351,227 to Copp Jr. et al. (referenced above), the swash plate compressor 10 includes a front and a rear cylinder block 18F,18R, respectively, in which is provided a crankcase, generally designated by the reference numeral 19. The crankcase 19 contains two oppositely disposed and aligned sets of axial cylinder bores 20. One bore 20 of each set is provided in each cylinder block 18F and 18R. Only the bottommost bores 20 in the blocks 18F, 18R are shown in FIG. 1. Any suitable number of sets, such as five may be employed.

A double head piston 22 is slidingly engaged for reciprocal motion within each set of the cylinder bores 20. The reciprocating action of the pistons 22 is utilized to compress the refrigerant. The compressed refrigerant is discharged from discharge port 24 in the end walls and is subsequently transferred from the compressor 10 for utilization by the air conditioning system to condition air being directed to a vehicle interior (not shown). The low pressure refrigerant gas is then returned to the compressor 10 to an inlet port 26 to complete the cycle.

A central drive shaft 28 is axially aligned within the cylinder blocks 18F, 18R of the crankcase 19. The drive shaft 28 extends externally from the crankcase 19 and is attached through a clutch 30 to a pulley 32. A belt 34 is attached to the pulley 32 and to the engine (not shown). During engine operation, the belt 34 transmits power from the engine through the pulley 32 and the drive shaft 28 to the compressor 10.

A swash plate 36 is provided for reciprocating the pistons 22 through attachment to the drive shaft 28. It is observed that, at any particular piston 22, the angle of the swash plate 36 constantly changes as the swash plate rotates, thus generating a continuous wave form and thereby imparting the reciprocating motion to each piston 22. Bearings 38 are provided as a part of each piston assembly to minimize the frictional resistance. A constant flow of lubricant fluid over the bearings and other operating components within the crankcase 19 is assured.

In operation, the low pressure refrigerant fluid is introduced into inlet chamber 39 of the compressor 10 through the inlet port 26 and passes into crankcase chamber 42. The refrigerant fluid is in gaseous form with a liquid lubricant mist interspersed therein. The lubricant coats all the internal components that it contacts, such as the swash plate 36 and bearings 38. The excess drops to the bottom of the crankcase 19 forming the pool P of the lubricant where it is then recirculated, as is known.

Reference will now be made to both figures in describing the preferred embodiment of the present invention. A suction porting assembly 12 is provided in the operating heads or ends 23 of at least the bottommost, double ended piston 22. The individual suction ports 46 are circular passages that extend longitudinally through the piston heads 23 and are connected on the face of the piston by a 360° channel 47. During the intake stroke, refrigerant gas communicates through these suction ports 46 and is drawn from the chamber 42 into each of the compression chambers 14 in turn. The ports 46 are annularly arranged on the head 23 of the piston 22, whereby a constant radius arc is maintained from a central longitudinal axis L (see FIG. 2). Additionally, there is equiangular spacing; i.e. the angular separation in the array of the ports 46, is constant and maintained at substantially 30° between each port in the preferred embodiment.

However, in accordance with the invention, the ports 46 are in a horizontally asymmetrical arrangement. That is, there are no ports included in the lowermost portion of the piston head 23. More particularly, the lowermost ports extend only substantially 30° below the horizontal center-line of the piston head 23. Accordingly, the ports are excluded from the lowermost portion of the piston head 23. More specifically, the exclusion of the ports extends in an arc of substantially 120° about the bottom of the piston; that is 60° each side of bottom dead center. This spacing is established by empirical means and data calculations, so that under normal operating conditions, the liquid pool P in the crankcase reservoir does not rise to the height of these lowermost ports 46. Hence, the ports are sufficiently spaced above the pool P so that there is no direct drawing of liquid lubricant with the gaseous refrigerant into the lowermost compression chamber 14, and the prior art slugging problem is essentially avoided.

There can be one or multiple ports 46, so long as the diameter of the port(s) is, sufficient to provide an aggregate flow volume of the refrigerant to substantially fill the associated compression chamber 14 on the expansion or intake stroke. It can be appreciated that if the diameter of the ports 46 is too small, the throughput of refrigerant is decreased, thereby diminishing the overall performance of the compressor 10.

The suction porting assembly 12 includes a unitary reed valve disc 48. This disc 48 has a central support cross piece and a ring 50 that extends in a circle to coincide with the suction ports 46 and the channel 47. The ring 50 has a width sufficient to cover all of channel 47 and thus the suction ports 46. The disc 48 is attached to the piston 22 by a central fastener 52. Further, the combination of the material composition and the thickness of the unitary disc 48 is sufficient to provide adequate strength and memory for the ring 50, whereby proper operation is realized.

During the expansion or intake stroke of the piston 22, the positive pressure differential between the crankcase 19 and the compression chamber 14 forces the ring 50 to flex open; that is, lift up and move away from the face of the piston head 23 and uncover the channel 47 and the end of each port 46 (see left hand piston head 23 in FIG. 1). This allows the refrigerant gas to pass from the crankcase 19 through the ports 46 into the compression chamber 14. As the discharge stroke begins and a negative pressure differential is realized, the disc 48 flexes back and closes; the ring 50 seating against the face of the piston head 23 and sealing the suction ports 46 (see right hand end). The presence of the channel 47 allows the pressure to equalize between the individual ports to smooth the flow. As the discharge stroke continues, the refrigerant is pressurized to the designed level within the compression chamber 14. In response, a discharge reed valve 54, provided at the discharge port 24, opens at the proper time to allow the refrigerant to pass from the compression chamber 14 and into the discharge chamber 56. This discharge chamber 56 is an annular cavity provided in both compressor heads 40F and 40R. The chamber 56 is connected to a compressor outlet port (not shown) where the refrigerant is removed from the compressor 10 and directed to the remainder of the automobile air conditioning system to condition the air.

In summary, various benefits and advantages are realized by the suction porting assembly 12 of the present invention. Among these advantages are smoother piston 22 operation, increased refrigerant throughput, enhanced compressor 10 reliability, and reduced noise.

These benefits combine to result in a product providing improved quality, performance, and correspondingly, customer satisfaction.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described to provide the best illustration of the principles of the invention and its practical application to thereby enable one of ordinary skill in the art to utilize the invention in various embodiments and with various modifications as is suited to the particular use contemplated. All such modifications and variations are within the scope of the invention as determined by the appended claims when interpreted in accordance with breadth to which they are fairly, legally and equitably entitled.

We claim:

1. In a refrigerant compressor of the type having a piston operating in a horizontally extending cylinder bore of a cylinder block and including a crankcase having a cavity for a pool of liquid lubricant adjacent the bottom, an improved suction port arrangement, comprising:

at least one suction port extending through an operating head of said piston so as to provide fluid communication for compressing in said bore;

valve means for providing unidirectional fluid flow through said port;

said port being horizontally positioned so as to be excluded from the lowermost portion of said piston and spaced above said pool;

whereby liquid lubricant is substantially prevented from flowing through said port to eliminate slugging.

2. In a refrigerant compressor of the type having a piston operating in a horizontally extending cylinder bore of a cylinder block and including a crankcase having a cavity for a pool of liquid lubricant adjacent the bottom, an improved suction port arrangement, comprising:

a plurality of suction ports extending through an operating head of said piston so as to provide fluid communication for compressing in said bore, said ports being positioned along a constant radius arc with an angle of substantially 30° separating consecutive ports, and having a horizontally asymmetric arrangement such that said ports are excluded from the lowermost portion of said piston and spaced above said pool; and valve means for providing unidirectional fluid flow through said ports;

whereby liquid lubricant is substantially prevented from flowing through said ports to eliminate slugging.

3. In a refrigerant compressor of the type having a piston operating in a horizontally extending cylinder bore of a cylinder block and including a crankcase having a cavity for a pool of liquid lubricant adjacent the bottom, an improved suction port arrangement, comprising:

a plurality of suction ports extending through an operating head of said piston so as to provide fluid communication for compressing in said bore, said ports being positioned along a constant radius arc with an angle of substantially 30° separating consecutive ports, and having a horizontally asymmetric arrangement such that said ports are excluded from the lowermost portion of said piston defined by an arc of substantially 120° and spaced above said pool;

valve means for providing unidirectional fluid flow through said ports, said valve means including a flexible ring supported from the center of the piston head; and a channel extending around the piston head to substantially equalize the pressure between the ports;

whereby liquid lubricant is substantially prevented from flowing through said ports to eliminate slugging.

* * * * *